US005496462A

United States Patent [19]

Albert

[11] Patent Number: 5,496,462

[45] Date of Patent: Mar. 5, 1996

[54] PROCESS FOR OBTAINING A FINE POWDER OF DENDRITIC CADMIUM

[75] Inventor: Luc Albert, Elancourt, France

[73] Assignee: Metaleurop S.A., France

[21] Appl. No.: 195,256

[22] Filed: Feb. 10, 1994

Related U.S. Application Data

[63] Continuation of Ser. No. 825,968, Jan. 27, 1992.

[30] Foreign Application Priority Data

Jan. 28, 1991 [FR] France ..... 9100922

[51] Int. Cl.[6] ..... C25C 5/02

[52] U.S. Cl. ..... 205/62; 205/560

[58] Field of Search ..... 205/62; 204/114, 204/115

[56] References Cited

U.S. PATENT DOCUMENTS 3,847,784 11/1974 Przybyla ..... 204/292

4,414,303 11/1983 Williamson ..... 429/217

*Primary Examiner*—John Niebling
*Assistant Examiner*—Brendan Mee
*Attorney, Agent, or Firm*—Blakely, Sokoloff, Taylor & Zafman

[57] ABSTRACT

The invention relates to a process for obtaining a fine powder of dendritic cadmium, characterized in that it comprises the following steps:

(a) electrolytic production of cadmium metal on an electrode, under conditions such that there is formed a sponge consisting of tangled polymorphic dendrites, (b) removal and washing of the sponge, (c) disintegration of the sponge in a pulpy medium under conditions such that the dendrites are released in order to obtain a dendritic powder of particle size essentially less than a specified limit.

6 Claims, 1 Drawing Sheet

G - 200

G - 200

G - 800

PROCESS FOR OBTAINING A FINE POWDER OF DENDRITIC CADMIUM

CROSS REFERENCES TO RELATED APPLICATIONS

This application is a continuation application of a co-pending application with application Ser. No. 07/825,968, filed Jan. 27, 1992, entitled "Process For Obtaining A Fine Powder of Dendritic Cadmium and Powder Obtained by the Process", having the same inventor and assignee and now abandoned.

BACKGROUND OF THE INVENTION

1. Field of the Invention

The present invention relates to a process for developing a dendritic cadmium powder and a powder obtained by the process.

2. Description of the Prior Art

In the general framework of the development of nickel/cadmium accumulators, the tendency is constantly to search for an improvement in performance. Thus the electrode structures are particularly designed so as to be able to contain a charge of active material which is as high as possible (maximum number of ampere-hours) and as available as possible (maximum current).

A particular aspect of research in the field has consisted in developing novel techniques for manufacturing electrodes which employ smaller quantities of these materials.

Thus, especially in the field of portable accumulators, the negative-electrode structure, usually made from sintered nickel, has been replaced by a structure called PBT in which a mixture of cadmium oxide and metallic powder is coated onto a strip. In this known technique, the role of the conductive powder is to distribute the current of electrons uniformly in the volume of the active mass of cadmium hydroxide.

Conventionally, a certain number of metallic powder types are used, either of-cadmium or of nickel. Often spherical or spheroidal, these known powders are added in significant proportions, typically of the order of 20% by weight, in order to achieve the required resistivity for the electrode.

The Japanese Patent Application published under the number 55-76,569 on June 9, 1980 teaches the development of such a powder and its incorporation into the electrode in such proportions.

The present invention is based on the observation according to which, with a powder which deviates from the spherical shape (in other words with a shape factor which is very much greater than 1), and in particular with a dendritic powder, the electrical performance is greatly improved and, in particular, the energy density is increased. This means that, in order to obtain the same performance as with an electrode of the prior art, a dendritic powder is added to the paste of the electrode in a quantity substantially less than a spherical powder, resulting in a weight gain.

Document FR-A-2,194,792 teaches a process for developing a porous electrode from a cadmium powder of acicular or dendritic nature. This powder, obtained by deposition on a electrode and then dry scraping, is then compressed in order to form the electrode and is entirely unsuitable for use as an agent for distributing the current as mentioned hereinabove. More precisely, the operating conditions described in this document are such that the powder does not have the required fineness. Furthermore, the principle of electrolysis described in this patent necessitates working with small quantities of electricity and with extremely frequent scrapings.

SUMMARY OF THE INVENTION

The present invention thus aims to provide an electrolytic process for obtaining a dendritic cadmium powder, which enables, by an appropriate control of simple parameters, a powder of particularly appropriate quality and properties, especially in terms of fineness, to be obtained for incorporating into a negative nickel/cadmium accumulator electrode. It also provides a process which can be implemented with significant quantities of electricity in order to obtain, before reduction to a powder, an electrode thickness which can reach several centimeters without suffering uniformity defects.

To this end, it relates to a process for obtaining a fine powder of dendritic cadmium, characterized in that it comprises the following steps:

(a) electrolytic production of cadmium metal on an electrode under conditions such that a sponge consisting of tangled polymorphic dendrites is formed, (b) removal and washing of the sponge, (c) disintegration of the sponge in a pulpy medium under conditions such that the dendrites are released in order to obtain a dendritic powder of particle size essentially less than a specified limit.

The invention also relates to a dendritic powder obtained by the abovementioned process, characterized in that its particles have the shape of ferns comprising a central stem from which secondary dendrites branch off obliquely.

DETAILED DESCRIPTION OF THE INVENTION

Figure 1:
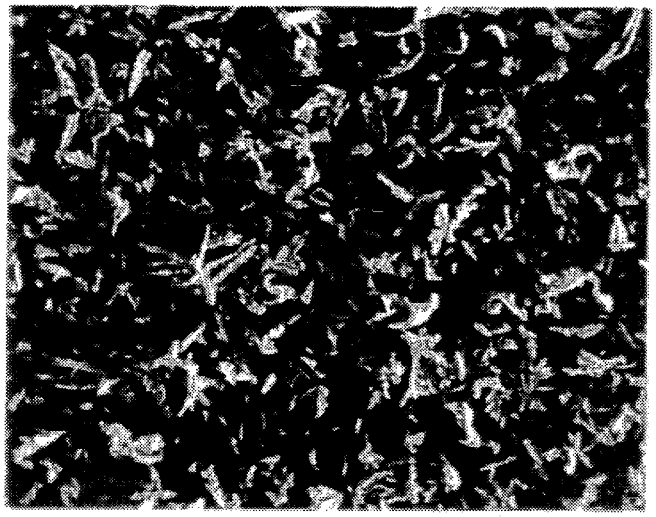
FIGS. 1 and 2 are microscope view-graphs illustrating the appearance of the cadmium powder obtained by the present invention.

An advantage of the process according to the invention resides in the fact that it offers the possibility of constituting a metallic matrix whose physical properties may be chosen without being subject to the strong constraint of particle size distribution. Thus the inventors have been able to determine the conditions for obtaining, by electrolytic deposition, a dendritic structure or alternatively a sponge structure. The transition from one structural shape to the other follows from the mode of crystallization. Thus, the dendritic structure changes towards the sponge structure when the cross-section of the crystals oriented in the field diminishes and when the two-dimensional nucleation is carried out on the pre-existing dendrites.

There is thus created, by entanglement, polymorphic dendrites constituting a real porous structure which is characterized by a very low cadmium space density (of the order of 0.1 $kg/dm^3$). It has also been observed that the conditions for generating the sponge could be adjusted in order to obtain a high coulombic efficiency, typically greater than 70%, rendering the process particularly economical from an energy aspect.

The constitution of the sponge by deposition on the cathode poses no particular difficulty in starting. It is possible to use substrates, for example made of stainless steel or of titanium. It is immaterial whether the surface is virgin or whether there remains thereon a cadmium residue from the previous operation.

By virtue of the process according to the invention, it is possible to produce cadmium sponges of very great thicknesses (typically 3 to 6 cm) which are characterized by:

- a good uniformity of structure over the entire thickness;
- a thickness development which is also uniform (absence of protuberances or of hollows over the free surface);
- a good adherence of the sponge to its substrate, enabling the electrode to be extracted from the electrolysis cell without risk of separation of the sponge or of the sponge falling off.

The separation of the sponge from its substrate (removal) is effected by gentle mechanical means of conventional type.

The separated sponge is then washed so as to recover the electrolyte with which it is still impregnated. Here also, the particular structure of the sponge permits a very efficient washing with a very small quantity of water.

Once washed, the sponge proves to be perfectly stable chemically, whether exposed to dissolution by acid attack or by oxidation in the air.

The second operation of the process consists in dilacerating the sponge. It is carried out in disintegration apparatuses having a tank which are provided with particular motory agitation devices, operating continuously or discontinuously. So as to promote a complete release of the particles of the sponge, it is preferable in this case to work with a level of pulp which does not exceed 200 g of dry material per liter. As will be seen later, the peripheral velocity of the motory agitation device is an important factor in obtaining an appropriate particle size.

After the disintegration operation, there is provided, advantageously but optionally, a sieving operation intended to eliminate the coarse particles and, preferably, the particles of size greater than 125 μm.

Another important characteristic of the present invention resides in the fact that the disintegration step releases particles whose size and solidity are essentially determined by the operating conditions of the electrolytic step for constituting the sponge and are only very slightly influenced by too long a dwell time of the material in the disintegration apparatus and by the choice of the geometry of the motory agitation devices. Thus several types of motory dilaceration devices have been tested, with or without counter-blades, without the morphology and the particle size of the powder being substantially modified. Furthermore, no overgrinding of the powder has been observed.

It has been established, moreover, that the particle size of the powder obtained, evaluated by the amount of residue at the sieving stage, was influenced only by the peripheral velocity of the motory dilaceration devices.

The good mechanical properties of the particles constituting the pulp allow storage in the decanted state without modification of the particle size distribution. Furthermore, the pulp obtained after disintegration may be pumped, for example by a vortex centrifugal pump, without undergoing alteration of particle size.

As will be seen in detail later, the morphology of the powder obtained is characteristic of the process according to the invention. The particles have the shape of ferns consisting of a central column from which secondary ferns branch off at an angle of the order of 60°. The overall shape is generally acicular, a shape well suited to the intended application.

There will now be described in more detail the actual implementation of the process according to the invention.

The electrolysis cell may be supplied either with a pure cadmium solution or with metallic cadmium of appropriate purity.

In the case of a cadmium solution, a concentrated solution is preferably chosen. The associated anion is advantageously sulphate. The acidity of the solution may vary, for example between 5 and 80 g/l of sulphuric acid. In order to obtain a cadmium powder of purity compatible with the intended application, the total content of metallic impurities in the solution, expressed in relation to cadmium, must be less than 100 g/t grams per ton, metric).

In the case where the electrolysis cell is supplied with cadmium metal, it may assume any appropriate form with, preferably, a purity of 99.99% or better. It is possible to use an anode which is cast or supplied as balls or rods of metal. Tests have shown that, regardless of the type of supply, the anodic reaction does not limit in any way the process for obtaining the cadmium sponge at the cathode.

The electrolyte is composed of cadmium sulphate and sulphuric acid. The acid content is conditioned by the desire for a high ionic conductivity of the electrolyte. This content is advantageously between 5 and 100 g/l, a value close to 50 g/l being particularly beneficial as it imparts a very good conductivity whilst limiting the acid corrosion of the sponge.

The choice of the cadmium concentration is closely bound up with the choice of the cathodic current density. Tests performed by the Applicant have revealed that, over the range of current densities going from approximately 700 to approximately 1500 $A/m^2$, it is advantageous that the cadmium concentration obeys the following relationships $$100A.m/kg \leqq J/(CD) \leqq 200A.m/kg$$

where J is the current density expressed in $A/m^2$ and (CD) is the cadmium concentration expressed in $kg/m^3$.

Thus, for a current density between 900 and 1200 $A/m^2$, the cadmiumconcentration is preferably between 4 and 15 g/l, more preferably between 7 and 11 g/l.

The operating temperature is maintained preferably within a range between 20° and 35° C., more preferably between 25° and 30° C.

As has been indicated, the cathodic substrate is preferably stainless steel or titanium. It has been observed that a good adherence of the sponge was obtained with a surface roughness corresponding to the original rolling state.

The circulation of the electrolyte is provided either naturally as oxygen is removed, for a cell having insoluble anodes, or in a forced manner. The choice of the type of circulation has practically no influence on the morphology of the sponge.

The duration of electrolysis between two removal operations is preferably between 4 and 8 hours. Under the optimized conditions of current density and of cadmium concentration such as mentioned hereinabove, a duration of the order of 6 hours is particularly suitable.

The actual design of the electrolysis cells is of conventional type and will not be described in detail. Use may be made, for example, of cells of the type used in the zinc or copper industry.

In the case of an electrolysis process using soluble anodes, it is observed that the composition of the electrolyte does not remain stable. In fact the reaction at the cathode, where protons are reduced and hydrogen is generated, constitutes a parasitic reaction which causes a decrease in the acidity of the medium, with which is associated an increase in the cadmium concentration.

According to a particular aspect of the present invention, in order to avoid the necessity of purging the cadmium system and adding acid, there is provision for combining the electrolysis process using soluble anodes with an electrolysis process using insoluble anodes working on the same electrolyte. By simple adjustment of the cathodic surface of the process operating with insoluble anodes, such that this surface constitutes a specified percentage of the total cathodic surface, a percentage equal to the cathodic coulombic efficiency for hydrogen removal, the abovementioned anodic dissolution excess is then precisely compensated for. The acidity consumed by the abovementioned parasitic reaction is also generated on the insoluble anodes. The system is therefore in overall equilibrium and may operate under practically stable conditions without requiring addition of material or purging, which guarantees a constant quality for the sponge formed and, consequently, for the powder.

After electrolysis and then removal and washing of the sponge as indicated hereinabove, the sponge is subjected to the disintegration operation. The dilaceration action is produced by a motory agitation device which does not have a significant pumping or shearing function. An effect is sought which is principally a shock effect on the peripheral portions of the motory device which have a small active surface.

As mentioned hereinabove, the essential parameter is the peripheral velocity of the motory device. It is preferably situated between 20 and 50 m/s for diameters of motory agitation devices varying between 83 and 380 mm. For velocities below this range, a rapid increase in the amount of particles rejected at sieving is observed. Specifically, it has been observed that, for a motory device having a diameter of 380 mm, a peripheral velocity of 30 m/s was sufficient in order to achieve a residue amount at 125 μm sieving less than 0.5%.

The dwell time of the sponges in the disintegration apparatus is for example between 3 and 5 minutes. It has been observed, however, that an excess dwell time of 100 to 200% in relation to these durations had no effect on the particle size distribution.

The pulp content is fixed at a value compatible both with the essential requirements for productivity of the process and with the essential requirement for preserving the particle size distribution. Specifically, a quantity of dry material per liter of pulping solution between 50 and 200 g/l proves to be appropriate. Above the upper limit, the particle size distribution becomes coarser.

The liquid medium used for obtaining the pulp should be chosen according to the following main criteria:

- in order to obtain a satisfactory particle size in the finished product, the medium should prevent agglomeration of the particles into which the sponge is split.
- it should give good settling and filtering properties to the particles.
- it should protect the particles from oxidation not only in the wet product but also in the finished dry product.

After the disintegration operation, the pulp is sieved as indicated hereinabove, for example with the aid of a vibrating screen. The Pulp is then decanted and conditioned. Under humid storage conditions a rate of oxidation less than 1% per month has been observed.

Figure 2:
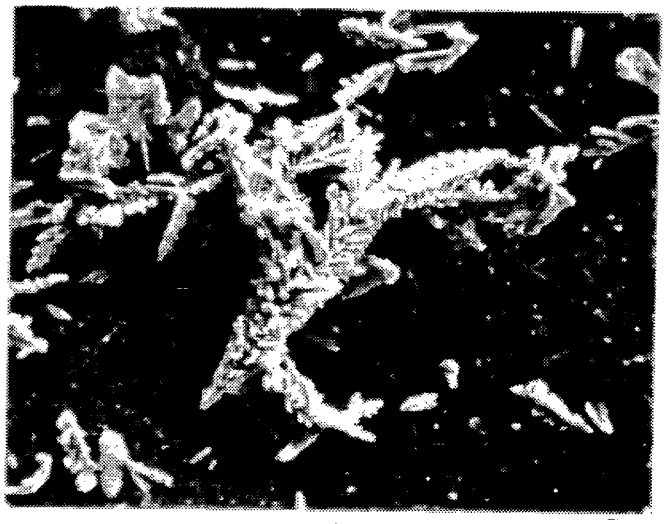

The appearance of the cadmium powder obtained is illustrated in the microscope view-graphs of FIGS. 1 and 2. The magnifications used were respectively 200 and 800. A dendritic powder is observed whose particles are in the shape of ferns characterized by a central stem, having a transverse cross-section of between approximately 4 and approximately 20 $\mu m^2$, on which have developed secondary dendrites oriented obliquely in relation to the direction of the stem with an average inclination of approximately 60°. The specific surface area of the powder, measured according to the BET method, is between 1 and 3 $m^2/g$. The average diameter, determined by laser granulometry, is approximately 20 μm, a typical particle size distribution being the following:

$d_{98}$≈64 μm $d_{90}$≈37 μm $d_{10}$≈7 μm

The process of the invention moreover guarantees a very high level of metallic cadmium in relation to the total cadmium. Thus it is observed that, despite a very high specific surface area, the final product is very little oxidized.

A typical composition is the following:

| |
|---|
| Total cadmium ≧ 99% |
| Cadmium metal ≧ 95% |
| Zn ≦ 50 g/t |
| Pb ≦ 30 g/t |
| Ni ≦ 10 g/t |
| Cu ≦ 10 g/t |
| Fe ≦ 30 g/t |
| $SO_4^{=}$ ≦ 50 g/t |

Of course the present invention is not in any way limited to the description hereinabove, but the person skilled in the art will be able to bring thereto any variant or modification in accordance with its scope.

EXAMPLE I

Ten tests have been performed with ten different pulping media in order to determine the optimum choice for these media.

The solutions used were:

a solution of potassium tetraborate ($K_2B_4O_7$, 4H O; 20 g/l);

clean water having pH=6.15 a slightly acidic solution ($H_2SO_4$) having pH=2.9 (concentration of 0.1 g/l)

a solution of boric acid ($H_3BO_3$) in different concentrations (from 0.6 to 0.1 g/l with a step of 0.1 g/l)

a potassic solution (KOH) at a concentration of 1 g/l.

In each case, 160 g of the wet sponge were introduced into 1000 ml of the pulping solution. The dilaceration operation was then conducted as defined above.

For each solution used, the initial and the final pH were measured. Also measured was the ratio of undersize particles, i.e. the percentage of particles desirably having a size lower than 1.25 μ/m. Further, the settling speed, the sieving speed and the filtration speed were qualitatively observed.

The results are shown in the following table.

TABLE

| Sol N° | Media | Content (g/l) | Initial pH | Final pH | Undersize ratio () |
|---|---|---|---|---|---|
| 1 | Borate | 20.00 | 9.40 | 9.40 | 97.57 |
| 2 | Water | | 6.15 | 9.50 | 92.64 |
| 3 | $H_2SO_4$ | 0.10 | 2.90 | 8.80 | 83.55 |
| 4 | $H_3BO_3$ | 0.6 | 5.60 | 8.80 | 95.80 |
| 5 | $H_3BO_3$ | 0.5 | 6.10 | 9.20 | 93.56 |
| 6 | $H_3BO_3$ | 0.4 | 5.90 | 9.00 | 94.26 |
| 7 | $H_3BO_3$ | 0.3 | 6.30 | 8.90 | 95.78 |

TABLE-continued

| | | | | | |
|---|---|---|---|---|---|
| 8 | $H_3BO_3$ | 0.2 | 7.20 | 8.80 | 90.45 |
| 9 | $H_3BO_3$ | 0.1 | 5.75 | 9.15 | 95.58 |
| 10 | KOH | 1.0 | 10.5 | 12.1 | 94.80 |

| Sol N° | Media | Content (g/l) | Settling | Sieving | Filtrability |
|---|---|---|---|---|---|
| 1 | Borate | 20.00 | medium | quick | quick |
| 2 | Water | | quick | medium | slow |
| 3 | $H_2SO_4$ | 0.10 | quick | quick | medium |
| 4 | $H_3BO_3$ | 0.6 | Flash | slow | slow |
| 5 | $H_3BO_3$ | 0.5 | Flash | slow | slow |
| 6 | $H_3BO_3$ | 0.4 | Flash | medium | medium |
| 7 | $H_3BO_3$ | 0.3 | quick | quick | medium |
| 8 | $H_3BO_3$ | 0.2 | medium | quick | medium |
| 9 | $H_3BO_3$ | 0.1 | medium | quick | quick |
| 10 | KOH | 1.0 | quick | quick | quick |

It should be noted that, due to air oxidation inside the sponge, part of the sponge matrix is already partially covered by cadmium hydroxide, which reacts with the solution during the dilaceration operation and promotes a pH increase.

Further, the metallic cadmium contents of the final powder was measured. With the solution No. 3, the metallic cadmium content was in the range of 70 to 80%. With the solutions Nos. 4–9, the metallic cadmium content was greater than 93%.

The main conclusions are as follows.

a) Starting with a pulping solution having a pH lower than 3 (solution No. 3) leads to a high level of agglomeration of the disintegrated particles, and further to a strong tendency to cadmium oxidation. The table shows that more than 15% of the cadmium is coarser than 1.25 μ/m.

b) At the end of the disintegration, the pH has raised to a value in a range from 8.8 to 12.1.

It should be observed that, at a pH under about 10, the cadmium is soluble in the liquid medium and any dissolved cadmium reprecipitates into loose cadmium hydroxide.

Such cadmium hydroxide affects the settling and filtering steps.

Therefore, it is desirable either to select the solution so that the initial pH is greater than about 9 to 10 (the potassic solution No. 10 is suitable), or to use borate or boric salt, which precipitates the cadmium.

c) The best results regarding settling, sieving and filtration speed are obtained with solutions Nos. 1, 3 and 6–10.

d) When dried, the powder which has been treated in borate solution (No. 1) is protected against further quick oxidation. More particularly, only a few percents of the metallic contents of the powder are lost after the dry powder has been exposed to air for several weeks.

On the contrary, with the solution No. 3, i.e. with an acidic medium, the powder in dry form violently reacts with air and burns.

EXAMPLE II

Several solutions of sodium pyrophosphate $Na_4P_2O_7$ were used as the pulping liquid. It has been observed that, at a concentration lower than 20 g/l cadmium hydroxide appears and decreases the filtration ability.

However, the use of such solution permits, much like borate, to obtain a dry cadmium powder which is protected against quick oxidation in air. Moreover, it has been determined that the metallic cadmium content of the final product is greater than 91%.

As a conclusion, the liquid medium should preferably be a solution of boric salt at pH greater than about 6 (solutions Nos. 6 to 9 of Example I), or a borate solution or caustic solution at pH greater than about 9 (solutions Nos. 1 and 10 of Example I), or a solution of sodium pyrophosphate at a concentration equal to or greater than about 20 g/l EXAMPLE II)

I claim:

1. A process for obtaining a fine powder containing dendritic cadmium, comprising the following steps:

(a) electrolytic production of metallic cadmium on an electrode, with a current density (J) between 700 and 1500 $A/m^2$, with a cadmium concentration (CD) in the electrolyte between 3.5 and 15 $kg/m^3$, and with an electrolytic solution composed of cadmium sulfate and sulfuric acid, the sulfuric acid content being between 5 and 100 g/I, and wherein the cadmium concentration in the electrolyte is specified by the relationship:

$$100\ A.m/kg \leqq J/CD \leqq 200 A.m/kg$$

whereby a sponge consisting of tangled polymorphic dendrites is formed, (b) removal and washing of the sponge, (c) disintegration of the sponge in a protective pulpy medium comprising approximately 50 to 200 g of cadmium sponge per liter of solution, said disintegration being performed in a disintegration tank having a peripheral motor-driven agitation device, the shape and speed of said device being chosen so as to obtain a dendritic powder, and (d) drying the pulp.

2. A process according to claim 1, wherein step (c) is conducted with a peripheral agitation device having a low active surface exposed to the pulp and with a peripheral velocity of between approximately 20 and 50 m/s.

3. A process according to claim 2, wherein step (c) is carried out over a period of time of more than three minutes.

4. A process according to claim 1, wherein step (a) is conducted at a temperature between 20° and 35° C.

5. A process according to claim 1, wherein step (a) is conducted at a temperature between 25° and 30° C.

6. A process according to claim 1, wherein the solution used for obtaining the pulpy medium is chosen in the group comprising a borate solution, a boric acid solution having a concentration of between 0.1 and 0.4 g/l, a potassium hydroxide solution having a pH greater than about 9 and a pyrophosphate solution having a concentration equal to or greater than approximately 20g/l.

* * * * *

UNITED STATES PATENT AND TRADEMARK OFFICE

CERTIFICATE OF CORRECTION

PATENT NO. : 5,496,462

DATED : March 5, 1996

INVENTOR(S) : Luc Albert

It is certified that errors appear in the above-identified patent and that said Letters Patent is hereby corrected as shown below:

In column 1 at line 8, please delete " application " and insert -- U.S. --.

In column 1 at line 40, please delete " -cadmium " and insert -- cadmium --.

In column 1 at line 63, please delete " a electrode " and insert -- an electrode --.

In column 4 at line 11, please delete " grams " and insert -- (grams --.

In column 4 at line 36, please delete "cadmiumconcentration" and insert -- cadmium concentration --.

Signed and Sealed this

Seventeenth Day of September, 1996

Bruce Lehman

*Attest:*

BRUCE LEHMAN

*Attesting Officer*

*Commissioner of Patents and Trademarks*